US007682663B2

(12) United States Patent
Fedorov et al.

(10) Patent No.: US 7,682,663 B2
(45) Date of Patent: Mar. 23, 2010

(54) REMOTE CURING OF POLYMER COATING BY GASEOUS, VAPOROUS OR AEROSOL INITIATING AGENT

(75) Inventors: Andrei V. Fedorov, Windsor (CA); Andrey A. Ermoshkin, Bowling Green, OH (US); Douglas C. Neckers, Perrysburg, OH (US)

(73) Assignee: Bowling Green State University, Bowling Green, OH (US)

( * ) Notice: Subject to any disclaimer, the term of this patent is extended or adjusted under 35 U.S.C. 154(b) by 974 days.

(21) Appl. No.: 11/360,224

(22) Filed: Feb. 23, 2006

(65) Prior Publication Data

US 2007/0196579 A1 Aug. 23, 2007

(51) Int. Cl.
*B05D 3/04* (2006.01)
*B05D 3/00* (2006.01)

(52) U.S. Cl. ..... 427/337; 427/331; 427/301; 427/302

(58) Field of Classification Search ..... 427/331, 427/337, 340, 341, 343
See application file for complete search history.

(56) References Cited

U.S. PATENT DOCUMENTS

| | | | | | |
|---|---|---|---|---|---|
| 3,169,079 | A | * | 2/1965 | Ferington et al. | 427/341 |
| 3,275,611 | A | | 9/1966 | Mottus et al. | 260/80.5 |
| 4,298,658 | A | * | 11/1981 | Thankachan et al. | 428/425.1 |
| 4,343,839 | A | | 8/1982 | Blegen | |
| 4,983,425 | A | | 1/1991 | Vara et al. | |
| 5,106,928 | A | | 4/1992 | Skoultchi et al. | 526/196 |
| 5,143,884 | A | | 9/1992 | Skoultchi et al. | 502/160 |
| 5,154,950 | A | * | 10/1992 | Rosthauser et al. | 427/340 |
| 5,286,821 | A | | 2/1994 | Skoultchi | 526/196 |
| 5,310,835 | A | | 5/1994 | Skoultchi et al. | 526/198 |
| 5,376,746 | A | | 12/1994 | Skoultchi | 526/196 |
| 5,539,070 | A | | 7/1996 | Zharov et al. | 526/198 |
| 5,616,796 | A | | 4/1997 | Pocius et al. | 564/9 |
| 5,621,143 | A | | 4/1997 | Pocius | 564/8 |
| 5,681,910 | A | | 10/1997 | Pocius | 526/198 |
| 5,686,544 | A | | 11/1997 | Pocius | 526/196 |

(Continued)

OTHER PUBLICATIONS

Welch, F.J., Polymerization of Methyl Methacrylate by Triethylboron-Oxygen Mixtures, Journal of Polymer Science, vol. 61, pp. 243-252 (1962).

(Continued)

*Primary Examiner*—David Turocy
(74) *Attorney, Agent, or Firm*—Roger A. Gilcrest

(57) ABSTRACT

The present invention is a method and apparatus for remote curing of resin-coated surfaces and articles by means of a vaporous curing agent. The method of the present invention includes the steps: (a) providing a surface of the substrate with a layer of a coating precursor comprising a curable material and a stabilized curing agent that is adapted to react with a gaseous, vaporous or aerosol initiating agent to activate the stabilized curing agent so as to cause the curable material to undergo a curing reaction; (b) subjecting the coating precursor to the gaseous, vaporous or aerosol initiating agent for sufficient time to initiate the curing reaction, and allowing the coating precursor to form a cured coating on the substrate. Another variation of the method of the present invention involves the reversal of the positions of the active compounds utilizing the interaction between the gaseous, vaporous or aerosol curing agent and coating precursor comprising a curable material and initiating agent.

15 Claims, 4 Drawing Sheets

U.S. PATENT DOCUMENTS

| | | | | |
|---|---|---|---|---|
| 5,690,780 | A | 11/1997 | Zharov et al. | 156/332 |
| 5,691,065 | A | 11/1997 | Zharov et al. | 428/421 |
| 5,718,977 | A | 2/1998 | Pocius | 428/422 |
| 5,795,657 | A | 8/1998 | Pocius et al. | 428/516 |
| 5,872,197 | A | 2/1999 | Deviny | 526/196 |
| 5,883,208 | A | 3/1999 | Deviny | 526/198 |
| 5,990,036 | A | 11/1999 | Deviny | 502/162 |
| 5,994,484 | A | 11/1999 | Pocius | 526/196 |
| 6,486,090 | B1 | 11/2002 | Moren | 502/171 |
| 6,706,831 | B2 | 3/2004 | Sonnenschein et al. | 526/196 |
| 6,710,145 | B2 | 3/2004 | Sonnenschein et al. | 526/196 |
| 6,713,578 | B2 | 3/2004 | Sonnenschein et al. | 526/196 |
| 6,713,579 | B2 | 3/2004 | Sonnenschein et al. | 526/196 |
| 6,730,759 | B2 | 5/2004 | Sonnenschein et al. | 526/196 |
| 6,734,268 | B2 | 5/2004 | Moren | 526/196 |
| 6,740,716 | B2 | 5/2004 | Webb et al. | 526/196 |
| 6,762,260 | B2 | 7/2004 | Sonnenschein et al. | 526/196 |
| 6,762,261 | B2 | 7/2004 | Deviny et al. | 526/198 |
| 6,777,512 | B1 | 8/2004 | Sonnenschein et al. | 526/196 |
| 6,806,330 | B1 | 10/2004 | Sonnenschein et al. | 526/196 |
| 6,825,298 | B2 | 11/2004 | Sonnenschein et al. | 526/196 |
| 6,867,271 | B1 | 3/2005 | Maandi et al. | 526/195 |
| 6,949,603 | B2 | 9/2005 | Sonnenschein et al. | 525/100 |

OTHER PUBLICATIONS

Brown, Herbert C. et al., Initiation Rates for Autoxidation of Trialkylboranes. Effect of a Steric Factor on the Initiation Rate, Chemical Communications, pp. 699-700 (1971).

Sonnenschein, Mark F. et al., Mechanism of Trialkylborane Promoted Adhesion to Low Surface Energy Plastics, Macromolecules 37, pp. 7974-7978 (2004).

Zhang, Xianping et al., Real-Time Monitoring of Polymerization Rates of Polyolacrylates by Fluorescence Probes. II. Effect of Depth of Polymerization for a Bleaching Photoinitiator System, Journal of Imaging Science and Technology, vol. 36, No. 4, pp. 322-327 (Jul./Aug. 1992).

Paczkowski, Jerzy et al., Following Polymerization Kinetics of Multifunctional Acrylates in Real Time by Fluorescence Probe Methodology, Macromolecules 25, pp. 548-553 (1992).

* cited by examiner

REMOTE CURING OF POLYMER COATING BY GASEOUS, VAPOROUS OR AEROSOL INITIATING AGENT

STATEMENT OF GOVERNMENTAL INTEREST

This invention was made with Government support under Contract Number N00014-04-1-0406 awarded by the Department of the Navy. The Government has certain rights in the invention.

TECHNICAL FIELD OF THE INVENTION

The present invention is in the field of polymeric coatings.

BACKGROUND OF THE INVENTION

In the field of polymeric coating, it is often desirable to place coatings of relatively high quality onto surfaces of complex shape, or surfaces that are not readily available to known coating methods, such as were surfaces that are in some way sequestered. Sequestered surfaces for example may be those on complex shapes, or those on multicomponent parts, such as car parts that are already assembled. In this regard, in industries such as the automobile industry, it is often desirable to be able to place a high quality coating on an automobile part (such as a body trim part) after it has been affixed to the automobile. One of the advantages of being able to coat such a part after assembly is that the risk of damage to the surface occasioned by its handling, or the use of fixtures, may be substantially reduced or eliminated.

In these instances, the automobile part may not be in a position to allow a coating to be cured effectively in situ by light or heat as a curing agent, or by the application of a chemical curing agent in a liquid form, in large part because portions of the surfaces, in addition to their complexity, cannot be reached or reached efficiently by any such curing agent.

In these and other applications, an assembled part may be near another material that might be damaged by use of any such curing agent.

Accordingly, there remains a need for methods to allow one to apply high quality coatings to surfaces of complex shapes or surfaces that otherwise are sequestered such that known techniques cannot be used or used efficiently. One example of such high quality coatings are those that involve thin coatings, including those that require especially high degree of uniformity and complete coverage of the surface.

Many applications in the modern coating industry can be improved if direct use of light and/or heat is avoided. Other applications require polymerization of heat sensitive materials in the locations which are not efficiently accessible for light. Still others may require polymerization where direct use of light and/or heat cannot be used efficiently. Accordingly, the present invention provides polymerization without direct use of light and/or heat representing an improvement over polymerization and cure systems of the prior art in the area of coatings.

Borane chemistry has been studied in great detail (for example see: Onak T. *Organoborane Chemistry* Academic Press: New York, 1975 and Brown H. C. *Boranes in Organic Chemistry* Cornell University Press: Ithaca, N.Y. 1972 (all incorporated herein by reference)). One of the most important properties of trisubstituted boranes is to initiate and catalyze the polymerization of the vinyl monomers. The mechanism of organoborane action has been a subject of several reports (for example see: H. C. Brown and M. M. Midland, *Chemical Commun.*, p. 699 (1971); F. J. Welch, J. Polym. Sci., vol. 61, pp. 243-252 (1962); and M. F. Sonnenschein, S. P. Webb, P. E. Kastl, D. J. Arriola, B. L. Wendt, D. R. Harraington, N. G. Rondan, *Macromolecules*, vol. 37, p. 7974 (2004) (all incorporated herein by reference)).

Mottus et. al. (U.S. Pat. No. 3,275,611 (incorporated herein by reference)) describes polymerization of olefins activated by the combination of organoborane, peroxygen compound and amine that could be added to the polymerizable resin together or separate. Many compositions are reported to be pyrophoric and display only marginal adhesion to the low energy surface substrates.

Skoultchi et. al. (U.S. Pat. Nos. 5,106,928; 5,143,884; 5,286,821; 5,310,835; 5,376,746 (all incorporated herein by reference)) describes two-part system for acrylic adhesive compositions involving activating of borane-amine complexes present in the first part by either carboxylic acids or aldehydes from the second part upon physical mixing.

The series of patents issued to Zharov et. al. (U.S. Pat. Nos. 5,539,070; 5,690,780; 5,691,065 (all incorporated herein by reference)) discloses a two-part adhesive systems utilizing borane-amine complexes with alkanol amines being the primary complexing agents.

Pocius et. al. (U.S. Pat. Nos. 5,616,796; 5,621,143; 5,681,910; 5,686,544; 5,718,977; and 5,795,657 (all incorporated herein by reference)) describes a two-part system for acrylic adhesive compositions containing borane-amine complexes with N:B atom ratio of 4 or less. Various amines, polyamines, and polyols are described as complexing agents. Isocyanates are disclosed as release agents to decomplex organoborane.

Other two-part adhesive systems for low surface energy substrates are described by Sonnenshein et. al. (U.S. Pat. Nos. 5,616,796; 5,621,143; 5,681,910; 5,686,544; 5,718,977; 5,795,657 (all incorporated herein by reference)), Deviny et. al. (U.S. Pat. Nos. 5,872,197; 5,990,036; 5,883,208; and 6,762,261 (all incorporated herein by reference)) and Moren et. al. (U.S. Pat. No. 6,734,268 (incorporated herein by reference)). In these disclosures, various borane-(mono, poly) amine complexes in the first part of the composition are activated by mixing with the second part of the composition containing various release agents (acids, acid anhydrides, acid halides, aldehydes and isocyanates).

Moren et. al. (U.S. Pat. No. 6,486,090 (incorporated herein by reference)) further discloses the utilization of hydroxide or alkoxide anions as complexing agents for borane with decomplexers selected from isocyanates, acids, acid chlorides, sulfonyl chlorides, or anhydrides.

Maandi et. al. (U.S. Pat. No. 6,867,271 (incorporated herein by reference)) proposes the stabilization of hydroxy-, alkoxy- and tetraalkyl borates and alkyl borohydride salts of alkali metals and quaternary ammonium cations within an inert carrier (i. e. tetraglyme) to which some aziridine containing compounds are added. The first part of the composition containing the stabilized borate initiator is mixed with the second part containing polymerizable resin with borate activation occurring upon mixing.

Many of polymerizable compositions described in the prior art demonstrate excellent properties including stability, strength and adhesion. However, all compositions previously reported are two-part compositions that require physical mixing of two condensed phases. This is disadvantageous because the control of the cure is limited, cure times are long, and application of the formulations to sequestered surfaces (including those surfaces where efficient or uniform application of light or heat is difficult). A more general coating process is needed that takes advantage of the useful properties of borane-amine complexes, uses the single formulation applied to the substrate, and eliminates all the disadvantages resulted from the use of two-part compositions.

SUMMARY OF THE INVENTION

The present invention is a method and apparatus for curing of precursor resin-coated surfaces and articles by means of a vaporous, gaseous or aerosol curing agent.

An important advantage of the present invention is the ability to deliver the components of the initiating mixture in a stream of a gas, vapor or aerosol, optionally with a carrier gas where necessary or desired. This initiating gas, vapor or aerosol is shapeless, and thus may occupy any volume and ensures the unrestricted accessibility to the entire surface to be coated. When brought in contact with the precursor-coated surface, the active ingredients of the initiating gas, vapor or aerosol will interact with the coating components, such as a stabilized or "passivated" curing agent to initiate the polymerization in the coating.

The present invention provides for the exposure of a one-part composition to a vaporous release agent and represents an advantage over two-part compositions described in the prior art. Previously described two-part compositions required physical mixing of two condensed phases to start the cure.

The cured coatings obtained from the method described in the present invention are expected to retain beneficial properties of the previously described two-part compositions such as good adhesion to the low energy surfaces.

In general terms, the method of the present invention includes providing a coating to a surface of a substrate, the method comprising the steps: (a) providing a surface of the substrate with a layer of a coating precursor, the coating precursor comprising a curable material and at least one stabilized curing agent that is adapted to react with at least one gaseous, vaporous or aerosol initiating agent to activate the stabilized curing agent so as to cause the curable material to undergo a curing reaction; (b) subjecting the coating precursor to the gaseous, vaporous or aerosol initiating agent for sufficient time to initiate the curing reaction, and allowing the coating precursor to form a cured coating on the substrate. The stabilized curing agent typically contains at least one first active ingredient, and the gaseous, vaporous or aerosol initiating agent contains at least one second active ingredient, such that, when the coating precursor is subjected to the gaseous, vaporous or aerosol initiating agent, the first active ingredient(s) and the second active ingredient(s) react to activate the curing agent which in turn cause the coating precursor to polymerize.

The method of the present invention also includes a method of providing a coating to a surface of a substrate, the method comprising the steps: (a) providing a surface of the substrate with a layer of a coating precursor, the coating precursor comprising a curable material comprising at least one resin selected from the group consisting of acrylic resins and resins that contain double C—C bonds capable of polymerization, and at least one stabilized curing agent selected from the group consisting of alkyl boranes complexed with a compound selected from the group consisting of amines or amidines and that is adapted to react with a gaseous, vaporous or aerosol initiating agent to activate the stabilized curing agent so as to cause the curable material to undergo a curing reaction; (b) subjecting the coating precursor to the gaseous, vaporous or aerosol initiating agent selected from the group consisting of gaseous, vaporous or aerosol acids, aldehydes, ketones, peroxides, isocyanates, ketenes, acid halides, acid anhydrides, oxygen and other agents capable of releasing borane from the at least one stabilized curing agent, for sufficient time to initiate the curing reaction, and allowing the coating precursor to form a cured coating on the substrate.

In another variation of the present invention, the methods of the present invention may be varied so as to reverse the relative positions of the stabilized curing agent(s) and the initiating agent(s). That is, the methods described above involve one part compositions containing borane-amine complex dissolved in polymerizable resin that could be remotely cured by a vaporous, gaseous or aerosol release agent delivered in a stream of a carrier gas. It is also possible to have the release or initiating agent(s) dissolved in the resin (in this case release initiating agent(s) do/does not have to be volatile) to comprise one part composition with the polymerization remotely activated by a vaporous, gaseous or aerosol stabilized curing agent(s), such as a vaporous, gaseous or aerosol borane-amine complex. Also, free uncomplexed vaporous, gaseous or aerosol trialkylborane can be used for this variation of the remote cure application. The other parameters of the method of the present invention as described herein may be the same as otherwise described herein.

Tables 9 and 10 demonstrate the feasibility of this reversed variation of the remote cure method of the present invention.

Considering both variations, the present invention in most general terms may be expressed as a method of providing a coating to a surface of a substrate, said method comprising the steps: (a) providing a surface of said substrate with a layer of a coating precursor, said coating precursor comprising a curable material and at least one first compound that is adapted to react with at least one gaseous, vaporous or aerosol second compound so as to cause said curable material to undergo a curing reaction; and (b) subjecting said coating precursor to said gaseous, vaporous or aerosol second compound for sufficient time to initiate said curing reaction, and allowing said coating precursor to form a cured coating on said substrate.

DETAILED DESCRIPTION OF THE INVENTION

The Surface

The surface to which the coating of the present invention may be applied may be any surface or partial surface of a two- or three-dimensional object. Typically, these surfaces may be any surface amenable to adhesion by the cured resin coating, such as metal, plastic or composite materials. The method of the present invention is most advantageous when used to coat non-planar surfaces, i.e., where light or heat curing cannot be most uniformly or efficiently used. The method of the present invention is therefore advantageous when seeking to apply a uniform coating either to planar surfaces, or to complex or sequestered surfaces, such as those that are difficult to cure using known heat- or light-curing techniques owing to inefficient heat transfer or inability to reach with light.

The Resins

The coating precursor may be any desired resin so long as it is a resin that may polymerize through the catalytic action of the stabilized or "passivated" curing agent once activated by the initiating agent.

In addition, the coating precursor resin may be comprised of one resin alone, or comprised of several resins as a given application may require or as may be preferred.

The thickness of the coating precursor may as appropriate for the demanded thickness of the coating to be applied. The thickness of the applied coating precursor generally will be in the range of from about 0.1 μm to about 1 mm, preferably from about 10 μm to about 400 μm, and most preferably from about 30 μm to about 200 μm.

The coating precursor preferably comprises an acrylic resin or a resin that contains double carbon-carbon bonds capable of polymerization. The acrylic resin may be composed of monomers known and used in the art (e.g., as described in U.S. Pat. No. 5,539,070 by Zharov: column 7, line 39 through column 10, line 43; U.S. Pat. No. 5,994,484 by Pocius: column 15 line 30 through column 19, line 60; and U.S. Pat. No. 6,867,271 by Maandi: column 5 line 20 through column 8 line 20), all of which are hereby incorporated herein by reference.

Organoborane and amine organoborane complex polymerizable compositions are described in U.S. Pat. Nos. 6,949,603; 6,825,298; 6,806,330; 6,777,512; 6,762,260; 6,740,716; 6,730,759; 6,713,579; 6,713,578; 6,710,145; and 6,706,831, all of which are hereby incorporated herein by reference.

It is preferred that the coating precursor be selected so as to be of sufficient stability to allow it to remain stable and viable of at least several weeks.

The method by which the coating precursor is placed on the surface to be coated is not critical to the invention, and may vary with the surface shape and degree to which all portions of the surface are reachable. The coating precursor may be placed on the surface to be coated through any appropriate method, such as by placing the coating precursor on the substrate for instance by pouring, dipping, painting with a brush, spraying, etc., and may include methods of resin deposition known and used in the art, or which may hereafter be developed. Accordingly, the present invention is not limited to the method by which the coating precursor is placed on the surface to be coated.

The resin may optionally include solvents, additives, fillers, co-initiators, pigments, etc., in accordance with those formulations known and used in the art, such as in those resins used for coating in manufacturing, such as automobile manufacturing. Accordingly, the present invention is not limited to the inclusion or absence of such materials.

Stabilized Curing Agents

The stabilized or "passivated" curing agent(s) may be any agent(s) adapted to begin the polymerization process once initiated through dissociation or similar process brought about by the initiating agent(s). The stabilized or "passivated" curing agent(s) and the initiating agent(s) may be any chemically compatible agents adapted to perform this function, and where, depending upon the variation of the method chosen the stabilized curing agent(s) or the initiating agent(s) may be rendered to or delivered as a gas, vapor or aerosol.

Preferably, the stabilized or "passivated" curing agent(s) comprise(s) compounds selected from the group consisting of complexes of alkyl boranes with amines and/or amidines, with a nitrogen:boron (N:B) ratio from 1:1 to 10:1.

The organoboranes used in accordance with the present invention may include a trialkyl borane or an alkyl cycloalkyl boranes. Preferably such borane corresponds to the formula $B—(R^2)_3$ wherein B represents Boron; and $R^2$ is separately in each occurrence an H atom, $C_{1-10}$ alkyl, $C_{3-10}$ cycloalkyl, or two or more of $R^2$ may combine to form a cycloaliphatic ring. Preferably, $R^2$ is $C_{1-4}$ alkyl, even more preferably $C_{2-4}$ alkyl. Among preferred organoboranes are triethyl borane, triisopropyl borane and tri-n-butylborane.

The amines used to complex the organoborane compound can be any amine or mixture of amines which complex the organoborane and which can be decomplexed when exposed to a decomplexing agent. The desirability of the use of a given amine in an amine/organoborane complex can be calculated from the energy difference between the Lewis acid-base complex and the sum of energies of the isolated Lewis acid (organoborane) and base (amine) known as binding energy. The more negative the binding energy the more stable the complex.

$$E_{binding}=E_{complex}-(E_{Lewis\ Acid}+E_{Lewis\ Base})$$

Such binding energies can be calculated using theoretical ab initio methods such as the Hartree Fock and/or Density Functional methods and various basis sets. To obtain more accurate results, binding energies could be corrected for zero-point vibrational energy and basis set superposition error contributions. These computational methods are available commercially employing commercial software and hardware such as SPARTAN software, commercially available from Wavefunction Inc. (hereby incorporated herein by the reference) and Gaussian software, commercially available from Gaussian Inc., which suites of programs operate with a computational workstation. Complexes having amine/organoborane binding energies of 10 kilocalories per mol or greater are preferred, complexes having a binding energy of 15 kilocalories per mol or greater are more preferred and even more preferred are complexes with a binding 20 kilocalories per mol or greater are most preferred.

Preferred amines include the primary or secondary or tertiary amines or polyamines containing primary or secondary or tertiary amine groups, or ammonia as disclosed in Zharov U.S. Pat. No. 5,539,070 at column 5, lines 41 to 53, incorporated herein by reference, Skoultchi U.S. Pat. No. 5,106,928 at column 2, line 29 to 58, incorporated herein by reference, and Pocius U.S. Pat. No. 5,686,544 at column 7, line 29 to Column 10 line 36, incorporated herein by reference; ethanolamine, secondary dialkyl diamines or polyoxyalkylenepolyamines; and amine terminated reaction products of diamines and compounds having two or more groups reactive with amines as disclosed in Deviny U.S. Pat. No. 5,883,208 at column 7, line 30 to column 8 line 56, incorporated herein by reference. With respect to the reaction products described in Deviny's patents the preferred diprimary amines include alkyl diprimary amines, aryl diprimary amines, alkylaryl diprimary amines and polyoxyalkylene diamines; and compounds reactive with amines include compounds which contain two or more moieties of carboxylic acids, carboxylic acid esters, carboxylic acid halides, aldehydes, epoxides, alcohols and acrylate groups. Preferred amines described in Deviny's patent include n-octylamine, 1,6-hexanediamine, diethylamine, dibutyl amine, diethylenetriamine, dipropylenediamine, 1,3-diaminopropane, 1,2-diaminopropane, 1,2-diaminoethane, 1,5-diaminopentane, 1,12-diaminododecane, 1,5-diamino-2-methylpentane, 1,5-diamino-3-methylpentane, triethylenetetraamine, 4-methylaminopyridine. Preferred polyoxyalkylene polyamines include poly(ethyleneoxide) diamines, poly(propyleneoxide) diamines, triethylene glycol propylene diamine, poly(tetramethyleneoxide) diamine and poly(ethyleneoxide)copoly(propyleneoxide) diamines.

When complexed with proper amine, the borane is deactivated. When an initiating agent (or release agent) is introduced to the system to interact with amine, the complex splits and borane is released to start acting as initiator of polymerization, as follows:

$$R_3B+NR'_3 \rightleftharpoons R_3B.NR'_3$$

$$R_3B.NR'_3+HA \rightarrow R_3B+HNR'^{+}_3A^{-}$$

Although not limited to the theory of the invention, mechanisms have been proposed and described in H. C. Brown and M. M. Midland, *Chemical Commun.*, p. 699 (1971); F. J. Welch, J. Polym. Sci., vol. 61, pp. 243-252 (1962); and M. F. Sonnenschein, S. P. Webb, P. E. Kastl, D. J. Arriola, B. L. Wendt, D. R. Harraington, N. G. Rondan, *Macromolecules*, vol. 37, p. 7974 (2004), all of which are hereby incorporated by reference.

In accordance with the present invention, remote polymerization is achieved by introduction of an initiating agent in a gaseous phase, which allows an access of any surface, and, as desired, without the use of heat and/or light.

Initiating Agents

The initiating agents may be selected from any gaseous, vaporous or aerosol initiating agent that is of a chemical character to cause the disassociation of the borane-amine complex, including those selected from the group consisting of gaseous, vaporous or aerosol acids, aldehydes, ketones and peroxides, and oxygen, as well as isocyanates, ketenes, acid halides, acid anhydrides, or any other agents capable of releasing borane from the complex.

The gaseous, vaporous or aerosol initiating agent may additionally comprise an inert carrier gas or mixture of inert gases, such as those selected from the group consisting of the periodic table group VIII noble gases, nitrogen or gases like air and oxygen, or any mixture of aforementioned gases.

The gaseous, vaporous or aerosol initiating agent may be obtained commercially or generated through any appropriate method, such as for example, through a chemical reaction or by saturation of carrier gas with vapors. They may be delivered to the coating precursor by any appropriate and effective means for the delivery of gaseous, vaporous or aerosol reactants, bearing in mind concerns for safety. The gaseous, vaporous or aerosol initiating agent contained or generated at a site remote from where the initiation reaction takes place. Accordingly, another aspect of the method of the present invention includes a method wherein step (b) above includes: (a) generating the gaseous, vaporous or aerosol initiating agent from a chemical reaction; and (b) exposing the surface of the substrate to the gaseous, vaporous or aerosol initiating agent and subjecting the coating precursor to the gaseous, vaporous or aerosol initiating agent for sufficient time to initiate the curing of the coating precursor.

Typically the surface is exposed to the gaseous, vaporous or aerosol initiating agent wherein the gaseous, vaporous or aerosol initiating agent is generated at a site remote from the surface. This may be done for instance by sequestering the object to be coated in a treatment chamber, and conducting the gaseous, vaporous or aerosol initiating agent into the treatment chamber. Such an arrangement may have the advantage of reducing the exposure of operators to harmful agents as well as to allow the treatment chamber to restrict release of harmful agents to the environment. The surface to be coated bearing the coating precursor may be held stationary or be moved within the chamber, such as through the use of known assembly line arrangements, or which may hereafter be developed. The treatment chamber used in accordance with this embodiment of the present invention may be provided in accordance with known constructions and arrangements, such as those used in industries using intramural material transmission and application.

Because one of the features of the method of the present invention is to deliver the components of the initiating mixture in gaseous, vaporous or aerosol form, with or without a carrier gas, this "energizing gas" is shapeless, and thus may occupy any volume and ensures the unrestricted accessibility to the entire surface to be coated. When brought in contact with the surface, the active ingredients of the "energizing gas" will interact with the coating components to initiate the polymerization in the coating. This also allows the gaseous, vaporous or aerosol initiating agent to be generated at a site remote from the surface to be coated, and conducted to the surface via a non-linear path if necessary.

The present invention enables the polymerization without direct use of light and/or heat represents a radical innovation in the area of coatings. Accordingly, the method of the present invention may be done in such as way such that the surface of the substrate is maintained at about the same temperature, typically around room temperature or below, while the coating precursor is curing. By this is meant that the coating precursor need not be subjected to temperatures or changes in temperature such as are normally required to have a coating cured by application of heat. Likewise, the method of the present invention may be done under conditions such that the surface of the substrate is maintained only at ambient light (i.e., non-curing light, or even the absence of light) while the coating precursor is curing, and even allows the surface of the substrate to be maintained substantially in the absence of any UV, visible or infrared light while the coating precursor is curing. By this is meant that the coating precursor need not be subjected to any amount of light such as it is normally required to have a coating cured by application of light.

This is particularly beneficial in situations where the surface to be coated extends over a three-dimensional object, such that the application of heat or light, or at least its uniform application, is not possible or practicable. The present invention thus also allows for the application of coatings to surfaces wherein the normal line extending from the surface is directed away from the source of the gaseous, vaporous or aerosol initiating agent.

As a preferred embodiment of the present invention, the method of the invention includes providing a coating to a surface of a substrate, the method comprising the steps: (a) providing a surface of the substrate with a layer of a coating precursor, the coating precursor comprising a curable material comprising at least one resin selected from the group consisting of acrylic resins and resins that contain double C—C bonds capable of polymerization, and at least one stabilized curing agent selected from the group consisting of alkyl boranes complexed with amines and/or amidines and that is adapted to react with a gaseous, vaporous or aerosol initiating agent to activate the stabilized curing agent so as to cause the curable material to undergo a curing reaction; and (b) subjecting the coating precursor placed onto the surface to the gaseous, vaporous or aerosol initiating agent selected from the group consisting of gaseous, vaporous or aerosol acids, aldehydes, ketones, peroxides, oxygen, isocyanates, ketenes, acid halides, acid anhydrides, or any other agent(s) capable of releasing borane from the complex for sufficient time to initiate the curing reaction, and allowing the coating precursor to form a cured coating on the substrate.

The gaseous, vaporous or aerosol initiating agent interacts with the coating precursor to initiate the polymerization reaction, allowing the coating to cure.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

DETAILED DESCRIPTION OF THE PREFERRED EMBODIMENTS

In accordance with the foregoing summary, the following describes examples of the present invention which include the best mode thereof.

Figure 1:
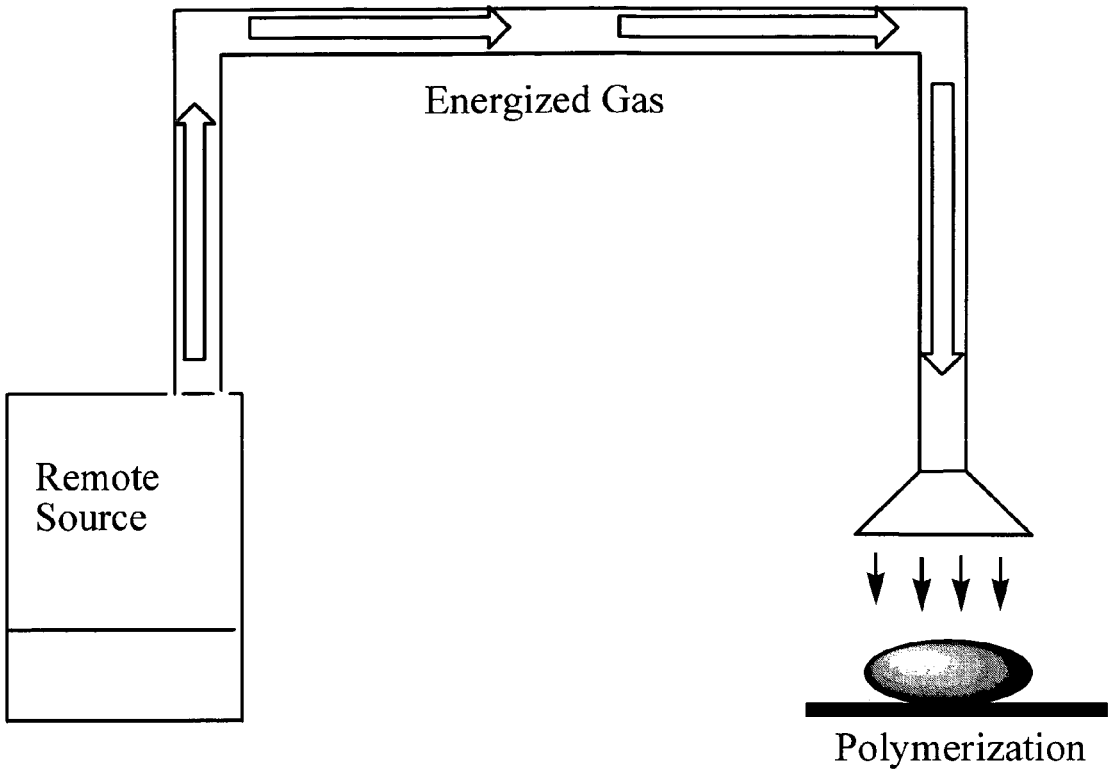
FIG. 1 is a schematic drawing of a remote curing system in accordance with one embodiment of the present invention.

FIG. 1 is a schematic drawing of a remote curing system in accordance with one embodiment of the present invention. This figure shows generally that the initiating agent, in the form of a gas, vapor or aerosol, may be conducted from a remote location where it is stored or generated through a chemical or physical reaction, to the surface bearing a coating precursor to initiate polymerization in accordance with the present invention.

Table 1 provides information regarding some of the borane/primary amine complexes and the initiating agents (referred to as remote cure or "RC" agents) that may be used in accordance with the present invention.

TABLE 1

Trialkylborane - Primary Amine Complexes: Characterization and Possibility of Utilization in Accordance with the Present Invention.*

| Complex | δ, ppm of $CH_3\underline{CH_2}$-B($CDCl_3$) | δ, ppm of $^{11}B$ | Pyro-phoricity | Cure at contact | RC agent | | | | |
|---|---|---|---|---|---|---|---|---|---|
| | | | | | $CH_3COOH$ | $CH_3CHO$ | $H_2O_2$ | Acetone | HCl |
| $Et_3B$ | 1.19 | 86.69 | Yes | Yes | N/A | N/A | N/A | N/A | N/A |
| $Bu_3B$ | 1.18 | 85.59 | Yes | Yes | N/A | N/A | N/A | N/A | N/A |
| | | ($C_6D_6$) | | | | | | | |
| $Et_3B{\bullet}NH_2NH_2$** | 0.17 | −1.76 | No | No | Yes | Yes | Yes | Yes | Yes |
| $Et_3B{\bullet}H_2N(CH_2)_6NH_2$ | 0.13 | −2.71 | No | No | Yes | No | Yes | No | Yes |
| $Et_3B{\bullet}CH_3CH(NH_2)—CH_2NH_2$ | 0.13 | −3.30 | No | No | Yes | No | Yes | No | Yes |
| $Bu_3B{\bullet}BuNH_2$ | 0.13 | −3.08 | No | Yes | Yes | Yes | Yes | Yes | Yes |
| $Et_3B{\bullet}CH_2{=}CH—CH_2NH_2$ | 0.16 | −2.05 | No | No | Yes | Yes | Yes | Yes | Yes |
| $Et_3B{\bullet}BuNH_2$ | 0.14 | −2.64 | No | No | Yes | Yes | Yes | No | Yes |
| $Et_3B{\bullet}NH_3$ | 0.16 | −3.08 | Yes | No | Yes | Yes | Yes | Yes | Yes |
| $Bu_3B{\bullet}NH_3$ | 0.18 | −2.71 | Yes | Yes | N/A | N/A | N/A | N/A | N/A |
| $Et_3B{\bullet}PhNH_2$ | 0.46 | 27.12 | Yes | Yes | N/A | N/A | N/A | N/A | N/A |
| $Et_3B{\bullet}PrNH_2$ | 0.14 | | No | No | Yes | Yes | Yes | Yes | Yes |
| $Et_3B{\bullet}PhCH_2NH_2$ | 0.24 | | No | No | Yes | Yes | Yes | Yes | Yes |
| $Et_3B{\bullet}$C-Pent-$NH_2$ | 0.16 | | No | Yes | N/A | N/A | N/A | N/A | N/A |
| $Et_3B{\bullet}iPrNH_2$ | 0.17 | | Yes | Yes | N/A | N/A | N/A | N/A | N/A |

*All polymerization experiments were carried out with dipropylene glycol diacrylate (DPGDA) containing 5% mass. of the complex. The exposure of the surface of the formulation (0.79 $in^2$) to a vaporous release agent ($CH_3COOH$) in the RC experiments was 2 min, argon flow was 430 mL/min, diameter of the gas delivery line - ¼". The following notations were used: Et—ethyl; Bu—butyl; Ph—phenyl; Pr—propyl; iPr—isopropyl; C-Pent—cyclopentane.

**Polymerization experiments were carried out with 1,6-hexanediol diacrylate (HDDA) containing 5% mass. of the complex. The exposure in the RC experiments was 3 min.

Table 2 shows examples of some of the borane/secondary amine complexes and the initiating agents (referred to as RC agents) that may be used in accordance with the present invention.

TABLE 2

Trialkylborane - Secondary Amine and Amidine Complexes: Characterization and Possibility of Utilization in Accordance with the Present Invention.*

| Complex | δ, ppm of $CH_3\underline{CH_2}$-B($CDCl_3$) | δ, ppm of $^{11}B$ | Pyro-phoricity | Cure at contact | RC agent | | | | |
|---|---|---|---|---|---|---|---|---|---|
| | | | | | $CH_3COOH$ | $CH_3CHO$ | $H_2O_2$ | Acetone | HCl |
| $Et_3B$ | 1.19 | 86.69 | Yes | Yes | N/A | N/A | N/A | N/A | N/A |
| $Et_3B$•Pyrrolidine | 0.19 | −1.54 | No | Yes | Yes | No | Yes | No | Yes |
| $Et_3B$•Piperidine | 0.19 | −0.66 | No | Yes | N/A | N/A | N/A | N/A | N/A |
| $Et_3B$•$Et_2NH$ | 0.28 | 4.10 | Yes | Yes | N/A | N/A | N/A | N/A | N/A |
| $Et_3B$•$(Me_2N)_2C{=}NH$ | 0.16 | −1.91 | No | Yes | N/A | N/A | N/A | N/A | N/A |
| $Et_3B$•$(Me_2N)_2C{=}NH$ + 100% mass of $(Me_2N)_2C{=}NH$** | — | — | No | No | Yes | No | Yes | No | Yes |

*All polymerization experiments were carried out with dipropylene glycol diacrylate (DPGDA) containing 5% mass. of the complex. The exposure of the surface of the formulation (0.79 $in^2$) to a vaporous release agent ($CH_3COOH$) in the RC experiments was 2 min, argon flow was 430 mL/min, diameter of the gas delivery line - ¼".
**The complex is stabilized by an excess of the uncomplexed ligand.

Table 3 shows examples of some of the borane/tertiary amine complexes and the initiating agents (referred to as RC agents) that may be used in accordance with the present invention.

TABLE 3

Trialkylborane - Tertiary Amine Complexes: Characterization and Possibility of Utilization in Accordance with the Present Invention.*

| Complex | δ, ppm of $CH_3\underline{CH_2}$-B($CDCl_3$) | δ, ppm of $^{11}B$ | Pyro-phoricity | Cure at contact | RC agent | | | | |
|---|---|---|---|---|---|---|---|---|---|
| | | | | | $CH_3COOH$ | $CH_3CHO$ | $H_2O_2$ | Acetone | HCl |
| $Et_3B$ | 1.19 | 86.69 | Yes | Yes | N/A | N/A | N/A | N/A | N/A |
| $Et_3B$•$NMe_3$** | 0.46 | | Yes | Yes | N/A | N/A | N/A | N/A | N/A |
| $Et_3B$•Py** | 0.47 | −2.49 | No | Yes | N/A | N/A | N/A | N/A | N/A |
| $Et_3B$•DBU** | 0.29 | | No | Yes | N/A | N/A | N/A | N/A | N/A |
| $Et_3B$•4-$Me_2N$—$C_5H_4N$ | 0.36 | | No | No | Yes | No | Yes | Yes | Yes |

*All polymerization experiments were carried out with dipropylene glycol diacrylate (DPGDA) containing 5% mass. of the complex. The exposure of the surface of the formulation (0.79 $in^2$) to a vaporous release agent ($CH_3COOH$) in the RC experiments was 2 min, argon flow was 430 mL/min, diameter of the gas delivery line - ¼".

**Polymerization experiments were carried out with 1,6-hexanediol diacrylate (HDDA) containing 5% mass. of the complex. The exposure in the RC experiments was 3 min.

DBU represents a diazabicycloundecene.

Table 4 shows examples of some of the acrylic and methacrylic monomers that may be used in accordance with the present invention.

TABLE 4

Stability and Remote Cure Response of Formulations Containing Commonly Used Acrylic and Methacrylic Monomers and Triethylborane - 4-(N,N-Dimethylaminopyridine) complex.*

| Monomer | Stability of Formulation, % of Double Bond Spontaneously Converted during Storage at Ambient Conditions** | | | Remote Cure Response, Film Thickness in μm (% of Double Bond Converted) of Formulations Exposed after Storage at Ambient Conditions for Designated Times** | |
|---|---|---|---|---|---|
| | 1 hr | 2 hr | 12 hr | 10 min | 2 hr |
| Acrylates | | | | | |
| 2-(2-ethoxyethoxy) Ethyl Acrylate | 0 | 0 | 0 | N/A*** (75) | N/A*** (86) |
| 1,6-Hexanediol Diacrylate | 0.5 | 1 | 3 | 140 (42) | 240-301 (34) |
| Dipropylene Glycol Diacrylate | 0 | 0 | 0 | 43 (94) | 150 (89) |
| Trimethylolpropane Triacrylate | 0 | 0 | 0 | 57 (16) | 81 (35) |
| Ethoxylated Pentaerythritol Tetraacrylate | 0 | 0 | 0 | 39 (49) | 34 (64) |
| Methacrylates | | | | | |
| Isobornyl Methacrylate | 4 | 4 | — | N/A*** (58) | N/A*** (68) |
| Neopentyl Glycol Dimethacrylate | 0 | 2 | 4 | 299 (20) | 359 (34) |
| Trimethylolpropane Trimethacrylate | 1 | 1.5 | — | 115 (25) | 130 (26) |

*Experimental conditions: Formulation - Monomer + 5% of Triethylborane← 4-(N,N-Dimethylaminopyridine) complex. Polymer films have been obtained by exposing the 2 mm thick layer of the formulation for 2 minutes to the flow of a vaporous release agent ($CH_3COOH$) delivered in the stream of argon (area 0.79 $in^2$, flow 430 mL/min, gas line diameter - ¼"). The thickness of the polymer films formed has beenmeasured by a micrometer. The percent of the double bond converted within the film has been determined by a near IR spectroscopy.
**Humidity - 45%, Temperature - 25° C., Ambient Light.
***Entire volume of the monomer polymerizes during 30 minutes after the formulation exposure.

Table 5 shows examples of some of the initiating agents (referred to as RC agents) that may be used to activate triethylborane-4-N,N-dimethyl-aminopyridine (4-DMAP) complex in accordance with the present invention.

TABLE 5

Remote Cure Response of a Formulation Containing $Et_3B$← 4-DMAP Complex to Different Release Agents.*

| Release Agent | Film Thickness, μm | % of Double Bond Converted |
|---|---|---|
| Formic Acid (HCOOH) | 120 | 68 |
| Acetic Acid ($CH_3COOH$) | 81 | 35 |
| Propionic Acid ($C_2H_5COOH$) | 70 | 38 |
| Acrylic Acid ($CH_2$=CHCOOH) | 46 | 59 |
| Hydrochloric Acid (HCl) | 33 | 71 |
| Boron Tribromide ($BBr_3$) | 4 | N/A** |
| Acetic Acid Anhydride $(CH_3CO)_2O$ | N/A*** | N/A |
| Silicon Tetrachloride ($SiCl_4$) | 95 | 65 |
| Tin Tetrachloride ($SnCl_4$) | 16 | N/A** |
| Oxalyl Chloride $(COCl)_2$ | 148 | 74 |

TABLE 5-continued

Remote Cure Response of a Formulation Containing $Et_3B$← 4-DMAP Complex to Different Release Agents.*

| Release Agent | Film Thickness, μm | % of Double Bond Converted |
|---|---|---|
| Acetyl Chloride ($CH_3COCl$) | 73 | 62 |
| Benzoyl Chloride (PhCOCl) | 9 | N/A** |

*Experimental conditions: Formulation - Trimethylolpropane Triacrylate (TMPTA) + 5% of Triethylborane← 4-(N,N-Dimethylaminopyridine) complex. Polymer films have been obtained by exposing a 2 mm thick layer of the formulation (area 0.79 $in^2$) for 2 minutes to the flow of a vaporous release agent delivered in the stream of argon (flow 430 mL/min, gas line diameter - ¼"). The thickness of the polymer films formed has been measured by a micrometer.The percent of the double bond converted have been determined by a near IR spectroscopy.
**The near IR spectrum of the film is not suitable for the determination of the ratio between aliphatic and olefinic hydrogens.
***No film formation observed, some gelation occurred after 30 minutes of the formulation exposure.

The complex $Et_3B.4\text{-}Me_2N—C_5H_4N$ was found to have the following beneficial properties: (1) its mixture with various monomers was stable for at least 60 minutes; (2) polymerization was initiated by the action of inert gas containing the vapors of various release agents, (3) in some particular cases, the process may start from the surface of contact with the gas and proceeds toward the inside into the volume of the monomer.

Table 6 shows yet other examples of some of the initiating agents (referred to as RC agents) that may be used to activate triethylborane-hydrazine complex in accordance with the present invention.

TABLE 6

Remote Cure Response of a Formulation Containing $Et_3B$← Hydrazine Complex to Different Release Agents.*

| Release Agent | Film Thickness, μm | % of Double Bonds Converted |
|---|---|---|
| Formic Acid (HCOOH) | 80 | 77 |
| Acetic Acid ($CH_3COOH$) | 120 | 82 |
| Propionic Acid ($C_2H_5COOH$) | 85 | 35 |
| Acrylic Acid ($CH_2$=CHCOOH) | 6 | 64 |
| Hydrochloric Acid (HCl) | 18 | 6.5 |
| Acetic Anhydride ($(CH_3CO)_2O$) | 71 | 78 |
| Boron Tribromide ($BBr_3$) | 3 | N/A** |
| Silicon Tetrachloride ($SiCl_4$) | 10 | 37 |
| Tin Tetrachloride ($SnCl_4$) | 135 | 67 |
| Oxalyl Chloride $(COCl)_2$ | 127 | 65 |
| Acetyl Chloride ($CH_3COCl$) | 54 | 69 |
| Benzoyl Chloride (PhCOCl) | 8 | N/A** |
| Ortho-Chlorophenol (o-$ClC_6H_4OH$) | N/A*** | N/A |

TABLE 6-continued

Remote Cure Response of a Formulation Containing $Et_3B$← Hydrazine Complex to Different Release Agents.*

| Release Agent | Film Thickness, μm | % of Double Bonds Converted |
|---|---|---|
| Acetone ($CH_3COCH_3$) | N/A*** | N/A |
| Acetic Aldehyde ($CH_3CHO$) | 380 | 76 |
| Tolylene 2,4-diisocyanate (at 20° C.) | N/A*** | N/A |
| Tolylene 2,4-diisocyanate (at 100° C.) | 35 | 54 |
| Sulfur Dioxide ($SO_2$) | 117 | 74 |

*Experimental conditions: Formulation - Trimethylolpropane Triacrylate (TMPTA) + 5% of Triethylborane← 4-(N,N-Dimethylaminopyridine) complex. Polymer films have been obtained by exposing a 2 mm thick layer of the formulation (area 0.79 $in^2$) for 2 minutes to the flow of a vaporous release agent delivered in the stream of argon (flow 430 mL/min, gas line diameter - ¼"). The thickness of the polymer films formed has been measured by a micrometer.The percent of the double bond converted have been determined by a near IR spectroscopy.

**The near IR spectrum of the film is not suitable for the determination of the ratio between aliphatic and olefinic hydrogens.

***No film formation occurs or very thin gel-like film not suitable for future investigation has been obtained.

Table 7 shows examples of some formulations (resins) consisting of mixtures of the acrylic and methacrylic monomers and urethane/acrylate or epoxy/acrylate oligomers that may be used in accordance with the present invention.

TABLE 7

Thickness of the Film for Remotely Cured Typical Coating Formulations.[a]

| Formulation | Amount of Excess Amine, % mass (% mol)[b] | Stability of Formulation for 1 Hour[c] at 20° C. | at 60° C. | Thickness of the Film, μm[d] |
|---|---|---|---|---|
| Wood Coating: Urethane Acrylate (Blended with | 0 (0) | + | − | 79 |
| Ethoxylated$_3$ Trimethylolpropane Triacrylate) 54.3%; | 5.54 (10) | + | ± | 90 |
| Tripropylene Glycol Diacrylate 13.0%; Polyethyleneglycol | 11.08 (20) | + | + | 71 |
| (400) Diacrylate 7.6%; Ethoxylated$_3$ Trimethylolpropane | 27.74 (50) | + | + | 41 |
| Triacrylate 9.8%; Propoxylated$_2$ Neopentyl Glycol | | | | |
| Diacrylate 12.0%; Dipentaerythritol Pentaacrylate 3.3% | | | | |
| Polycarbonate Coating: Tris(2-Hydroxyethyl) | 0 (0) | + | − | 115 |
| Isocyanurate Triacrylate 30.2%; Urethane Acrylate | 11.08 (20) | + | + | 92 (76) |
| 15.0%; 1,6-Hexanedione Diacrylate 22.7%; | 27.74 (50) | + | + | 86 (82) |
| Pentaerythritol Tetraacrylate 20.0%; Tetrahydrofurfuryl | | | | |
| Acrylate 10.1%; Silicone Surface Additive 2.0% | | | | |
| Glass Coating: Acrylated aliphatic urethane (Ebecryl | 27.74 (50) | + | − | 57 |
| 8800 - UCB) 50%; Isobornyl acrylate 40%; Beta- | 111 (200) | + | + | 38 (43) |
| carboxethyl Acrylate 10% | | | | |
| Aluminum Coating: Acrylated Epoxy Resin (Ebecryl 3720 - | 111 (200) | + | + | 115 (90) |
| UCB) 36.9%; Multifunctional acrylate (OTA-480-UCB) | | | | |
| 34.3%; Tripropylene Glycol Diacrylate 18.2%; Beta- | | | | |
| carboxethyl Acrylate 10.6% | | | | |
| Tile Coating: Acrylated aliphatic urethane (Ebecryl 8800 - | 0 (0) | + | − | 110 |
| UCB) 70%; Multifunctional acrylate (OTA-480 - UCB) | 5.54 (10) | + | + | 102 |
| 15%; Isobornyl acrylate 15% | | | | |

TABLE 7-continued

Thickness of the Film for Remotely Cured Typical Coating Formulations.[a]

| Formulation | Amount of Excess Amine, % mass (% mol)[b] | Stability of Formulation for 1 Hour[c] at 20° C. | at 60° C. | Thickness of the Film, μm[d] |
|---|---|---|---|---|
| Metal Paint: Proprietary Formulation (protected by U.S. Pat. No. 6,211,262 incorporated herein by reference) | 0 (0) | + | − | 107 |
| | 55.5 (100) | + | + | 83 (77) |

[a]Coating formulations contain 5% of Triethylborane - 4-(N,N-dimethylamino)pyridine complex. Amine used - 4-(N,N-dimethylamino)pyridine. Release agent - vaporous formic acid (HCOOH). Polymer films have been obtained by exposing the 2 mm thick layer (area 0.79 $in^2$) for 2 minutes to the flow of release agent delivered in the stream of argon(flow 430 mL/min, gas line diameter - ¼"). The thickness of the polymer film formed has been measured by a micrometer.
[b]The amount of excess amine added is relative to the amount of a Borane-Amine complex present in the formulation.
[c]The following criteria were used: + stable; ± marginally stable; − unstable. The formulation was considered stable if no visible signs of gelation and/or polymerization occurred for designated time under specified conditions.
[d]Prior to the remote cure release agent exposure, the formulations prepared have been stored at 20° C. for 1 hour. The numbers in parentheses represent the thickness of the coating obtained for the formulations stored for 1 hour at 60° C. prior to exposure to a remote cure release agent.

It has been found that the properties of the borane-amine system are sensitive to changes in the composition around the 1:1 borane-amine ratio point. Borane-amine complex within the coating formulation can be stabilized by addition of an excess of a free amine. This stabilization results from shifting the equilibrium towards the complexed form caused by the presence of a free amine.

Table 8 shows examples of stabilization of several borane-amine complexes upon addition of excess amine ligand that may be used in accordance with the present invention. The remote cure response has been measured for formulations stored for designated times.

TABLE 8

Remote Cure Response for the Formulations, Containing Borane-Amine Complex, Stabilized by the Addition of a Corresponding Amine.[a]

| Complex | Amount of Corresponding Amine Added, % mass (% mol)[b)] | Stability of formulation at 25° C. | Storage time | Film Thickness, μm |
|---|---|---|---|---|
| $Et_3B{\bullet}H_2N(CH_2)_6NH_2$ | 0 (0) | >1 h | 1 h | 124 |
| $Et_3B{\bullet}CH_3CH(NH_2)CH_2NH_2$ | 0 (0) | >1 h | 1 h | 146 |
| | 86 (200) | >1 h | 1 h | 121 |
| $Et_3B{\bullet}$Pyrrolidine | 0 (0) | 7 min | N/A | N/A |
| | 84 (200) | >30 min | 30 min | 200 |
| $Et_3B{\bullet}H_2N{-}CH(CH_3)_2$ | 0 (0) | <0.1 min | N/A | N/A |
| | 38 (100) | 40 min | 15 min | 134 |
| | | | 30 min | 165 |
| | 150 (400) | 40 min | 30 min | 350-425[c)] |
| $Et_3B{\bullet}((CH_3)_2N)_2C{=}NH$ | 0 (0) | <0.5 min | N/A | N/A |
| | 54 (100) | 6 min | N/A | N/A |
| | 108 (200) | >15 min | 15 min | 265[c)] |

[a]Formulation - Trimethylol Propane Tracrylate (TMPTA), containing 5% by weight of the borane-amine complex. Polymer films have been obtained over the layer of the formulation (depth of 2 mm, area 0.79 $in^2$) by exposing this layer for 2 minutes to the HCOOH vapors delivered in the stream of argon(flow 430 mL/min, gas line diameter - ¼"). The thickness of polymer film formed has been measured by a micrometer.
[b)]The amine added to stabilize the formulation was the same as the amine in the structure of borane-amine complex used in the formulation. The amount of amine added is relative to the amount of Borane-Amine complex, presenting in the formulation.
[c)]Exposure time - 5 minutes.

The use of a release agent and borane-amine complex as active components in the gaseous and liquid phases, respectively, could be reversed in yet another embodiment of the present invention. It is possible to have the release agent dissolved in the resin (in this case release agent does not have to be volatile) to comprise one part composition administered to the surface of a substrate with the polymerization remotely activated by a vaporous, gaseous or aerosol borane-amine complex delivered in a stream of a carrier gas.

Table 9 demonstrates examples of how vapors of borane-amine complexes when brought in contact with the coating could be activated by the release agents present in the coating formulation.

TABLE 9

Thickness of Films Prepared from Formulations Remotely Cured by Vapors of Borane-Amine Complex.[a]

| Complex | Amount of HCOOH in the Formulation, % mass | Film Thickness, μm |
|---|---|---|
| $Et_3B \bullet H_2NNH_2$ | 0 | N/A |
| maintained at 60° C. | 5 | 50 |
| | 10 | 35 |
| | 20 | 11 |
| $Et_3B \bullet H_2NNH_2$ | 0 | N/A |
| maintained at 100° C. | 5 | 38 |
| | 10 | 6 |
| | 20 | 20 |

TABLE 9-continued

Thickness of Films Prepared from Formulations Remotely Cured by Vapors of Borane-Amine Complex.[a]

| Complex | Amount of HCOOH in the Formulation, % mass | Film Thickness, μm |
|---|---|---|
| $Et_3B \bullet H_2N—CH(CH_3)_2$ | 0 | 0 |
| maintained at 25° C. | 5 | 5 |
| | 10 | 4 |
| | 20 | 5 |

[a]Experimental Conditions: Formulation - Trimethylolpropane Triacrylate (TMPTA) + designated percent of Formic Acid (HCOOH). Polymer films have been obtained from the layer of the coating formulation (depth of 2 mm) by exposing this layer for 2 minutes to the vapors of borane-amine complex, delivered in a stream of argon (flow 430 mL/min, gas line diameter - ¼"). The thickness of a polymer film formed has been measured by a micrometer.

In yet another embodiment of the present invention, a free uncomplexed vaporous, gaseous or aerosol organoborane delivered in a stream of a carrier gas can be used to initiate remote cure of the coating.

Table 10 demonstrates examples of how vapors of uncomplexed borane can initiate the polymerization of various monomers.

TABLE 10

Summary of the Remote Cure Experiments Involving Uncomplexed Borane Vapors[a]

| Monomer | RC Response | % DB Conversion[b] | Comments |
|---|---|---|---|
| Methyl Methacrylate | No immediate response | 98.8 | No polymerization, solution gets slightly warm after accumulation of borane, removal of the gas flow and external stirring. Overnight, the polymer forms. |
| Ethyl Acrylate | Yes | N/A | Takes several minutes to see thickening of the formulation |
| 2-(2-ethoxyethoxy) Ethyl Acrylate | Yes | 85.0 | Standard observations[c] |
| 1,6-Hexanediol Diacrylate | Yes | 93.4 | Standard observations[c] |
| Trimethylolpropane Triacrylate | Yes | 64.5 | Standard observations[c] |
| Corrosion Resistant Metal Paint | Yes | N/A | The paint surface cures instantly on a contact. However, the paint underneath does not cure due to the lack of borane vapor access. The measured cure depth is 7 mil (175 μm). |

[a]Experimental conditions: Polymer films have been obtained by exposing the 2 mm thick layer of the monomer to the flow of a vaporous release agent (triethylborane: $B(CH_2CH_3)_3$) delivered in the stream of argon (area 0.79 $in^2$, flow 430 mL/min, gas line diameter - ¼").
[b]Percent of the double bond conversion has been measured by a Near IR.
[c]The film of the polymer forms instantly on a contact. If not mixed, the borane vapors do not penetrate the film and monomer remains unreacted under the film. Stirring results in intense polymerization.

Table 11 compares the remote cure efficiency of several carrier gases that may be used in accordance with the present invention.

TABLE 11

The Effect of The Carrier Gas on the Remote Cure Process[a]

| Carrier Gas | Film Thickness, mm | % of Double Bonds Converted |
|---|---|---|
| Argon | 104 | 72 |
| Air | 88 | 48 |
| Nitrogen | 91 | 62 |

[a]Experimental conditions: Formulation - trimethylolpropane triacrylate (TMPTA) containing 5% of Triethylborane - 4-(N,N-Dimethylaminopyridine) complex. Polymer films have been obtained over the layer of the formulation (area - 0.79 $in^2$, depth - 2 mm) by exposing this layer for 2 minutes to the flow of HCOOH vapors delivered in the stream of a Carrier Gas (flow - 430 mL/min, gas line diameter - ¼"). The thickness of the polymer film formed has been measuredby a micrometer. The percent ratio of double bond converted has been determined by a near IR spectroscopy.

Argon has been found to be an efficient carrier gas for the remote cure method.

Some control experiments were conducted to establish the influence of different factors on the remote polymerization process and possibility of utilization of Cure Monitor technology to monitor real time profiles of a remotely cured system. The experiments featured dipropylene glycol diacrylate monomer (DPGDA) containing 5% by weight of the complex (4-DMAP), with reactions carried out in the 20 mL vial, wherein $m_{sample}$=1.0 g, and an exposure time to the vaporous release agent ($CH_3COOH$) of 5 minutes.

Cure Monitoring represents monitoring polymerization using a fluorescent probe is a sensitive measure of changes of microviscosity and molecular environment in the changing resin. The details of the method are described in the U.S. Pat. Nos. 5,606,171; 5,7171,217; and 5,955,002, and by Zhang, X.; Kotchetov, I. N.; Paczkowski, J.; Neckers, D. C. *J. Imag. Sci. Tech.* 1992, 36, 322; Paczkowski, J.; Neckers, D. C. *Macromolecules,* 1992, 25, 548, all of which are hereby incorporated by reference.

Experiments were conducted using CM-1 000 cure monitor device for monitoring the real-time curing profiles for remote cure systems in accordance with the present invention. The experimental conditions included the use of complex $Et_3B$.(4-Me2N—C5H4N) (i.e., Sample C) with the initiation agent being vapors of $CH_3COOH$ delivered in a nitrogen stream (flow 430 mL/min, gas line diameter—¼"). The monomer used was DPGDA containing 0.1% by weight of fluorescent probe—5-dimethylamino napthalene-1-sulfonyl-n-butylamide (DASB).

The monitoring procedure involved use of an excitation wavelength of 350 nm, with the ratio calculated for intensities at 456 and 558 nm.

Polymerization was carried out in the thin layer of precursor resin deposited on the metallic plate, with plates placed in a treatment chamber.

The distance to the CM-1000 head was about 2.5-3 mm, with the head placed over the monomer.

During the first 60 seconds a flow of pure nitrogen was used after which vapors of AcOH were introduced.

Figure 2:
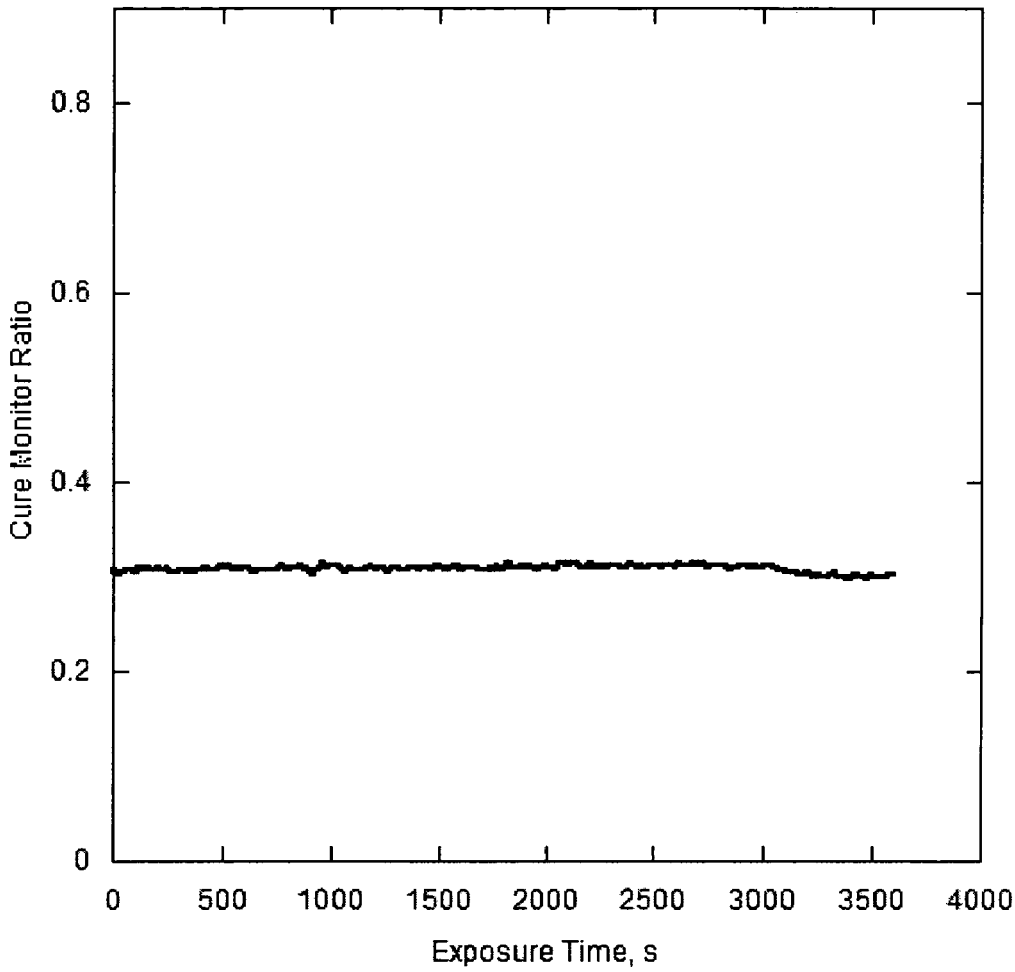
FIG. 2 is a graph demonstrating the stability over time of a system containing resin mixed with borane/amine complex used in accordance with one embodiment of the present invention.

FIG. 2 is a graph demonstrating the stability over time of a system containing resin mixed with borane/amine complex (DPGDA, 5% complex, 0.1% DASB) used in accordance with one embodiment of the present invention.

Figure 3:
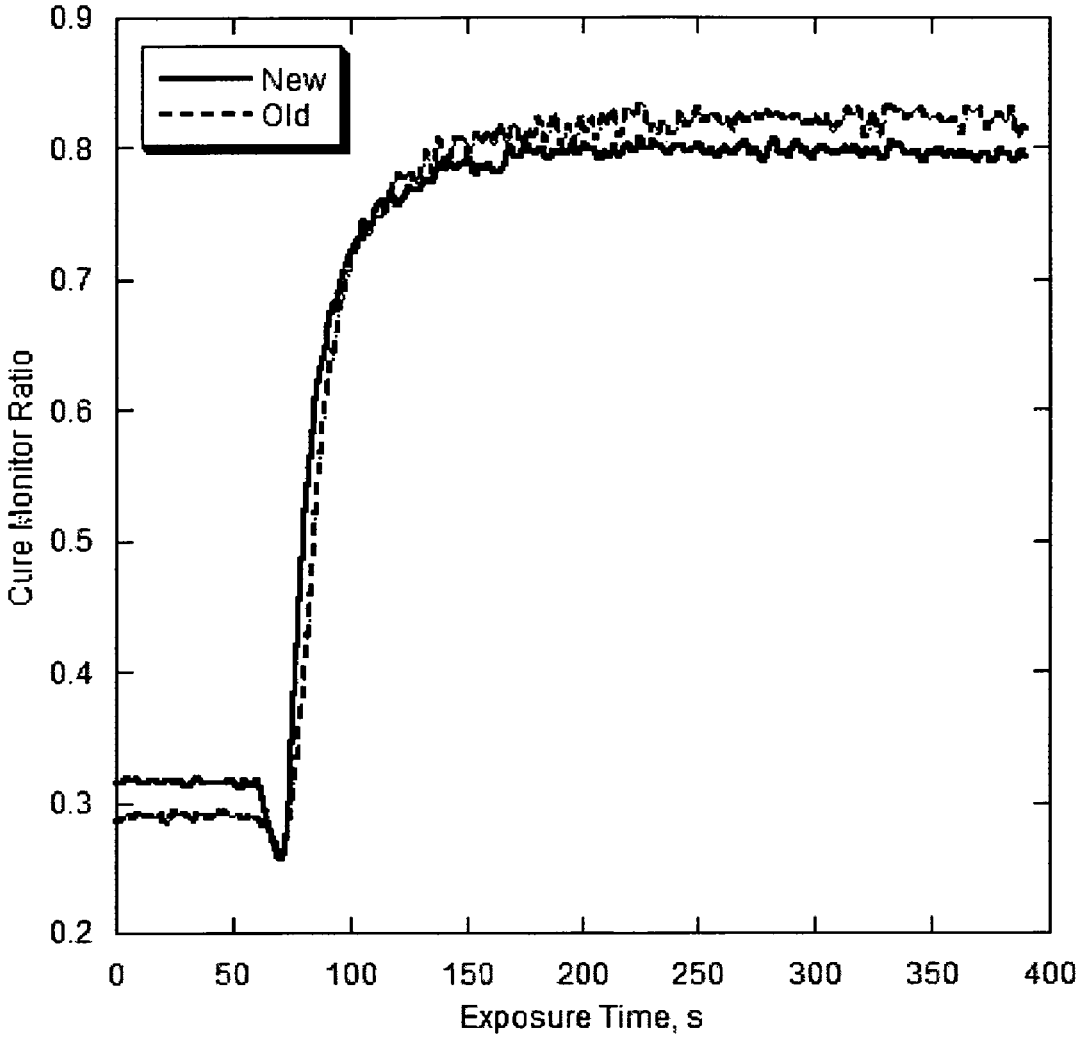
FIG. 3 is a graph demonstrating the reproducibility of results over time, in terms of the curing performance of a borane/amine complex, obtained using a method in accordance with one embodiment of the present invention.

FIG. 3 is a graph demonstrating the reproducibility of results over time, in terms of the curing performance of a borane/amine complex (DPGDA, 5% complex, 0.1% DASB), obtained using a method in accordance with one embodiment of the present invention.

Figure 4:
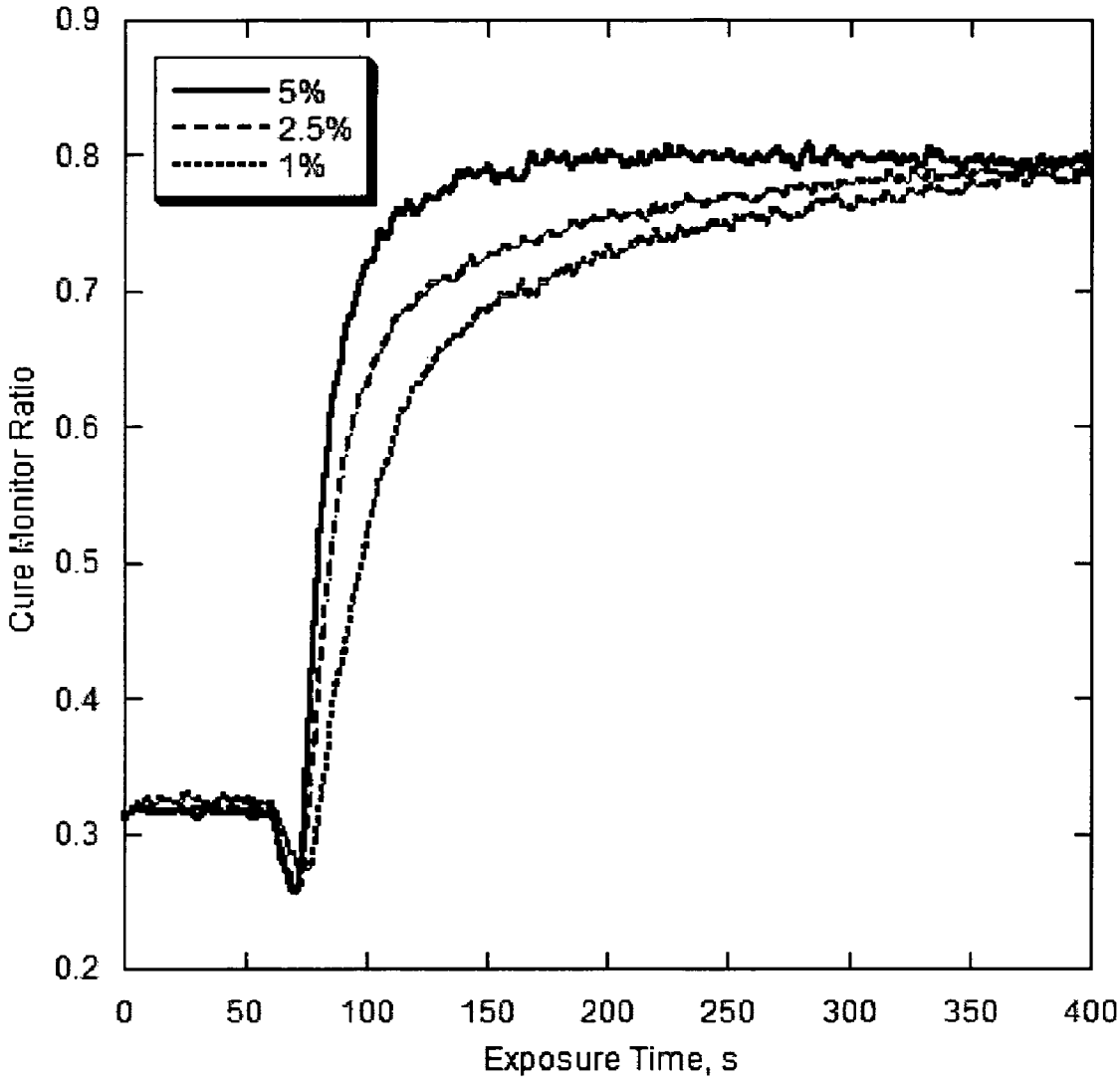
FIG. 4 is a graph demonstrating the effect of borane complex concentration on the polymerization profiles obtained in accordance with one embodiment of the present invention.

FIG. 4 is a graph demonstrating the effect of borane/amine complex concentration on the polymerization profiles (DPGDA, 0.1% DASB, concentration of the complex—5%, 2.5%, 1%) obtained in accordance with one embodiment of the present invention.

The foregoing description of the present invention is merely illustrative thereof, and it is understood that variations and modifications can be made without departing from the spirit or scope of the invention as set forth in the following claims.

What is claimed is:

1. A method of providing a coating to a surface of a substrate, said method comprising the steps:

(a) providing a surface of said substrate with a layer of a coating precursor, said coating precursor comprising a curable material and at least one first compound comprising a stabilized curing agent that is adapted to react with a gaseous, vaporous or aerosol second compound initiating agent so as to cause said curable material to undergo a curing reaction, wherein said coating precursor comprises an acrylic resin or a resin that contains double C—C bonds capable of polymerization, and said at least one first compound comprises a stabilized curing agent selected from the group consisting of complexes of alkyl boranes with amines and amidines with N:B ratio from 1:1 to 10:1;

(b) subjecting said coating precursor to said gaseous, vaporous or aerosol second compound initiating agent for sufficient time to initiate said curing reaction, and allowing said coating precursor to form a cured coating on said substrate.

2. A method according to claim 1 wherein said gaseous, vaporous or aerosol initiating agent is selected from the group consisting of gaseous, vaporous or aerosol acids, aldehydes, ketones, peroxides, oxygen, isocyanates, ketenes, acid halides, acid anhydrides, or any other agents capable of releasing borane from the complex.

3. A method according to claim 1 wherein said gaseous, vaporous or aerosol initiating agent additionally comprises an inert carrier gas selected from the group consisting of periodic table group VIII noble gases, nitrogen, air, oxygen and any mixture of aforementioned gases.

4. A method according to claim 1 wherein said gaseous, vaporous or aerosol initiating agent is generated at a site remote from said surface.

5. A method according to claim 1 wherein method includes:

(a) generating said gaseous, vaporous or aerosol initiating agent from a chemical reaction; and (b) exposing said surface of said substrate to said gaseous, vaporous or aerosol initiating agent and subjecting said coating precursor to said gaseous, vaporous or aerosol initiating agent for sufficient time to initiate the curing of said coating precursor.

6. A method according to claim 1 wherein said surface of said substrate is maintained at about the same temperature while said coating precursor is curing.

7. A method according to claim 1 wherein said surface of said substrate is maintained only in ambient light while said coating precursor is curing.

8. A method according to claim 1 wherein said surface of said substrate is maintained substantially in the absence of ultraviolet, visible or infrared light while said coating precursor is curing.

9. A method according to claim 1 wherein said surface extends over a non-planar surface.

10. A method according to claim 1, said method comprising the steps:

(a) providing a surface of said substrate with a layer of a coating precursor, said coating precursor comprising a curable material comprising at least one resin selected from the group consisting of acrylic resins and resins that contain double C—C bonds capable of polymerization, and said at least one first compound comprising a stabilized curing agent selected from the group consisting of alkyl boranes complexed with a compound selected from the group consisting of amines and/or amidines with N:B ratio from 1:1 to 10:1 and that is adapted to react with a gaseous, vaporous or aerosol initiating agent to activate said stabilized curing agent so as to cause said curable material to undergo a curing reaction; and (b) subjecting said coating precursor to said at least one second compound comprising a gaseous, vaporous or aerosol initiating agent selected from the group consisting of gaseous, vaporous or aerosol acids, aldehydes, ketones, peroxides, isocyanates, ketenes, acid halides, acid anhydrides, oxygen or any other agents capable of releasing borane from said at least one stabilized curing agent, for sufficient time to initiate said curing reaction, and allowing said coating precursor to form a cured coating on said substrate, and wherein said gaseous, vaporous or aerosol initiating agent additionally comprises an inert carrier gas selected from the group consisting of periodic table group VIII noble gases, nitrogen, air, oxygen and any mixture of aforementioned gases.

11. A method of providing a coating to a surface of a substrate, said method comprising the steps:

(a) providing a surface of said substrate with a layer of a coating precursor, said coating precursor comprising a curable material and at least one first compound comprising an initiating agent that is adapted to react with a gaseous, vaporous or aerosol second compound stabilized curing agent so as to cause said curable material to undergo a curing reaction, wherein said coating precursor comprises an acrylic resin or a resin that contains double C—C bonds capable of polymerization, and said at least one second compound comprises a stabilized curing agent selected from the group consisting of free uncomplexed alkyl boranes and complexes of alkyl boranes with amines and amidines with N:B ratio from 1:1 to 10:1;

(b) subjecting said coating precursor to said gaseous, vaporous or aerosol second compound stabilized curing agent for sufficient time to initiate said curing reaction, and allowing said coating precursor to form a cured coating on said substrate.

12. A method according to claim 11 wherein said at least one first compound comprises an initiating agent selected from the group consisting of acids, aldehydes, ketones, peroxides, oxygen, isocyanates, ketenes, acid halides, acid anhydrides, or any other agents capable of releasing borane from the complex.

13. A method according to claim 11 wherein said gaseous, vaporous or aerosol stabilized curing agent or free uncomplexed borane additionally comprises an inert carrier gas selected from the group consisting of periodic table group VIII noble gases, nitrogen, air, oxygen and any mixture of aforementioned gases.

14. A method according to claim 11 wherein said gaseous, vaporous or aerosol stabilized curing agent is generated at a site remote from said surface.

15. A method according to claim 11 wherein method includes:

(a) generating said gaseous, vaporous or aerosol stabilized curing agent from a chemical reaction; and (b) exposing said surface of said substrate to said gaseous, vaporous or aerosol stabilized curing agent and subjecting said coating precursor to said gaseous, vaporous or aerosol curing agent for sufficient time to initiate the curing of said coating precursor.

* * * * *